US006125582A

United States Patent [19]

Mondragon et al.

[11] Patent Number: 6,125,582

[45] Date of Patent: Oct. 3, 2000

[54] SPRING WINDER SUPPORT FOR DOOR COUNTERBALANCE SYSTEM

[75] Inventors: Joseph J. Mondragon, Dallas; LeRoy G. Krupke, Carrollton, both of Tex.; Michel Beaudoin, Drummondville, Canada; Richard K. Hoofard, Dallas; Erin J. Bittner, Irving, both of Tex.

[73] Assignee: Overhead Door Corporation, Dallas, Tex.

[21] Appl. No.: 09/313,460

[22] Filed: May 17, 1999

[51] Int. Cl.[7] ..... E05F 11/00

[52] U.S. Cl. ..... 49/200; 49/199; 160/200

[58] Field of Search ..... 49/199, 200; 160/189, 160/191, 192, 193, 201, 315, 318; 248/224.8, 225.11, 225.21

[56] References Cited

U.S. PATENT DOCUMENTS

| | | | |
|---|---|---|---|
| 667,302 | 2/1901 | Edwards | 160/315 |
| 1,247,938 | 11/1917 | Curtenius | 248/224.8 |
| 1,766,746 | 6/1930 | Heckman | 160/315 |
| 1,810,849 | 6/1931 | Nye | 160/315 |
| 2,257,484 | 9/1941 | Howe . | |
| 2,294,360 | 9/1942 | Blodgett . | |
| 2,786,231 | 3/1957 | Robinson . | |
| 3,038,535 | 6/1962 | Stroup et al. . | |
| 3,412,423 | 11/1968 | Binns . | |
| 4,930,182 | 6/1990 | Eichenberger . | |
| 4,981,165 | 1/1991 | Miller et al. . | |
| 5,239,777 | 8/1993 | Husselton . | |
| 5,275,223 | 1/1994 | Magro et al. . | |
| 5,419,010 | 5/1995 | Mullet . | |
| 5,577,544 | 11/1996 | Carper et al. . | |
| 5,615,723 | 4/1997 | Carper | 160/191 |
| 5,632,063 | 5/1997 | Carper et al. . | |
| 5,636,678 | 6/1997 | Carper et al. . | |
| 5,671,500 | 9/1997 | Balk . | |
| 5,778,490 | 7/1998 | Curtis | 160/191 |
| 5,865,235 | 2/1999 | Krupke et al. | 160/191 |
| 5,964,268 | 10/1999 | Carper et al. | 160/191 |

*Primary Examiner*—Daniel P. Stodola
*Assistant Examiner*—Curtis A. Cohen
*Attorney, Agent, or Firm*—Akin, Gump, Strauss, Hauer & Feld, L.L.P.

[57] ABSTRACT

A counterbalance system for an upward acting door includes spaced apart wall brackets supporting a tubular shaft for spaced apart cable drums operable to wind counterbalance cables thereon to counterbalance the weight of the door. Torsion springs interconnect the cable drums and spring winder tubes sleeved over the springs and connected to the wall brackets by a winder mechanism including a support plate having spaced apart tabs adapted to register in corresponding slots formed in a wall bracket. The winder mechanism includes a worm gear drive including a ring gear which is connected to one end of the winder tube by an arrangement of radially inwardly projecting key portions in a bore of the ring gear which register with axial grooves formed in the winder tube and are adapted to slide into transverse slots intersecting the grooves. A removable lock pin is engageable with the ring gear or the worm of the worm gear drive. The overall arrangement of the winder mechanism, including the wall bracket, support plate, and connection between the ring gear and winder tube facilitate ease of fabrication, assembly and disassembly.

22 Claims, 5 Drawing Sheets

SPRING WINDER SUPPORT FOR DOOR COUNTERBALANCE SYSTEM

FIELD OF THE INVENTION

The present invention pertains to an upward acting door counterbalance system including opposed torsion springs which are connected through a winder mechanism to system support brackets by an improved support structure.

BACKGROUND

Copending U.S. patent application Ser. No. 09/096,663, filed Jun. 12, 1998, by Leroy G. Krupke, et al. and assigned to the assignee of the present invention is directed to an improved torsion spring operated counterbalance system for an upward acting door. The counterbalance system described in the above referenced patent application is particularly advantageous with regard to the arrangement of the torsion springs being disposed within protective tubes which also form part of a spring anchor and winder mechanism.

In the further development of a counterbalance system, generally of the type disclosed and claimed in the above-referenced patent application, it was determined that certain improvements in the winder mechanism, including the manner in which the winder mechanism is connected to the system support brackets and the manner in which the spring protective winder tube is connected to the winder mechanism, was desirable. For example, a mechanically uncomplicated arrangement of the winder mechanism to include a minimum number of parts was deemed desirable. Still further, the manner in which the winder mechanism is connected to stationary support structure to form an "anchor" for the torsion coil springs was also deemed to require, or at least be desirably provided with an easier to install structure. As always, improvements are sought which will reduce manufacturing costs while, at the same time, provide a suitable or desirable structure which may be easily installed and serviced and is reliable in operation. It is to all of these ends that the present invention has been developed.

SUMMARY OF THE INVENTION

The present invention provides improved support structure for a spring anchor and winder mechanism for an upward acting door counterbalance system.

In accordance with one important aspect of the present invention, an upward acting door counterbalance system, including one or more torsion coil springs, is supported by one or more wall brackets mountable on a wall adjacent the door opening and the wall brackets are each connected to a removable support plate for a torsion spring anchor and winding mechanism in a manner which facilitates assembly and disassembly of the counterbalance system for purposes of installation and repair. In this regard, the spring winder mechanism includes a support plate member which is connected to the wall bracket by spaced apart tabs which fit in cooperating slots in the wall bracket to distribute torsion spring reaction forces substantially evenly to the wall bracket and wherein the winder support plate is biased by torsion spring forces to remain engaged with the wall bracket until spring torque is substantially reduced.

In accordance with another important aspect of the present invention, an upward acting door counterbalance system includes a spring winder mechanism which is mechanically uncomplicated and is easily connected to and supported by a combination of support elements, including a winder mechanism support plate which is easily connected to and disconnected from counterbalance system wall brackets.

In accordance with still another aspect of the present invention, a counterbalance system in accordance with the invention includes an improved arrangement whereby a normally stationary torsion spring support and protecting tube functions as a spring anchor member and is connected to a winder mechanism through a simplified connection or joint structure which facilitates ease of assembly and disassembly and relies at least in part on the normally present spring forces to maintain the winder tube connected to a ring gear of the winder mechanism.

Still further, the present invention provides a counterbalance system with improved locking mechanism to prevent unwanted movement of the spring winder mechanism to change the torsion spring forces which have been preset by the winder mechanism.

Those skilled in the art will further appreciate the above mentioned advantages and features of the invention, together with other important aspects thereof upon reading the detailed description which follows in conjunction with the drawing.

DETAILED DESCRIPTION OF A PREFERRED EMBODIMENT

Figure 1:
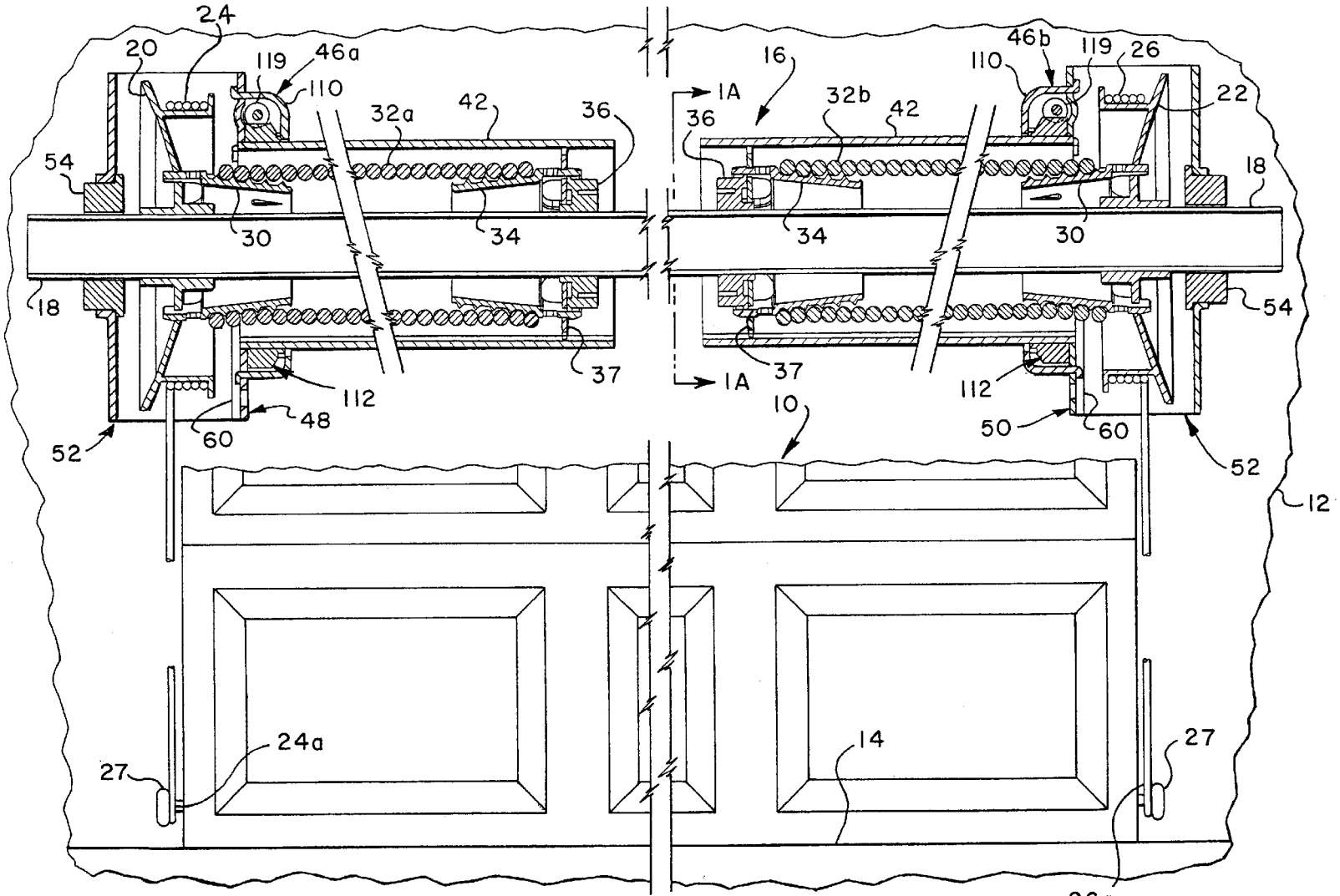
FIG. 1 is a front elevation of an upward acting door showing, in longitudinal central section, a counterbalance system including the support structure of the present invention.

In the description which follows, like parts are marked throughout the specification and drawing with the same reference numerals, respectively. The drawing figures are not necessarily to scale, and certain features may be shown exaggerated in scale or in somewhat generalized form in the interest of clarity and conciseness.

Figure 1A:
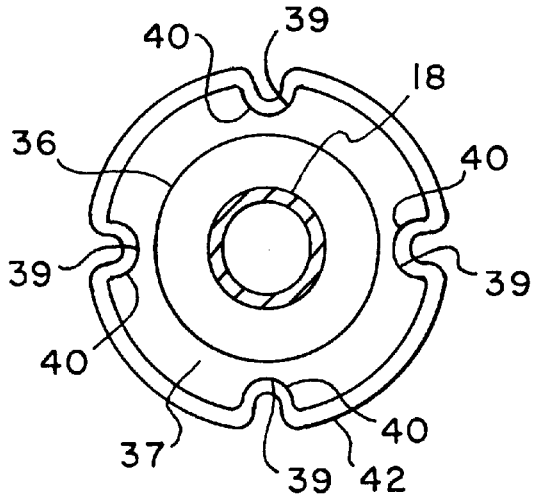
FIG. 1A is a view taken from line 1A—1A of FIG. 1.

Referring to FIG. 1, there is illustrated an upward acting door 10, which may, for example, comprise a sectional residential garage door. The door 10 is adapted to close over a vertical opening in a wall 12, the lower end of which terminates in a floor 14. The weight of the door 10 is counterbalanced by a counterbalance mechanism or system, generally designated by the numeral 16. The counterbalance system 16 is generally of a type described and claimed in U.S. patent application Ser. No. 09/096,663 filed Jun. 12, 1998 and referenced hereinbefore. In particular, the counterbalance system 16 comprises an elongated tubular shaft 18 which is adapted to synchronize the rotation of spaced apart cable drums 20 and 22 which have wound thereon, respectively, elongated flexible members comprising wire ropes or cables 24 and 26. The cable lower ends 24*a* and 26*a* are secured to the door 10 at suitable connecting members 27. Each of the cable drums 20 and 22 includes a spring hub member 30 suitably secured thereto and engageable with one end of a counterbalance spring 32*a* and 32*b*, respectively. The opposite ends of the counterbalance springs 32*a* and 32*b* are secured to spring anchor cone members 34, respectively, which are provided with suitable hub portions 36 axially slidably disposed on the shaft 18 and rotatable relative thereto. Each of the spring anchor members 34 is provided with a radially projecting circular flange 37, see FIG. 1A also, having suitable circumferentially spaced apart keyways or recesses 39 formed therein and engageable with elongated radially inwardly projecting key portions 40 formed on a generally cylindrical spring cover and winder tube 42 covering each of the springs 32*a* and 32*b*, respectively. Accordingly, each of the springs 32*a* and 32*b* is connected to a tube 42 by way of a spring anchor member 34 so that rotation of a tube 42 will tend to wind the coils of the springs 32*a* and 32*b* in one direction or another, depending on the direction of rotation of the tubes themselves. Spring anchor members 34 are also axially slidable within and relative to the tubes 42.

Figure 2:
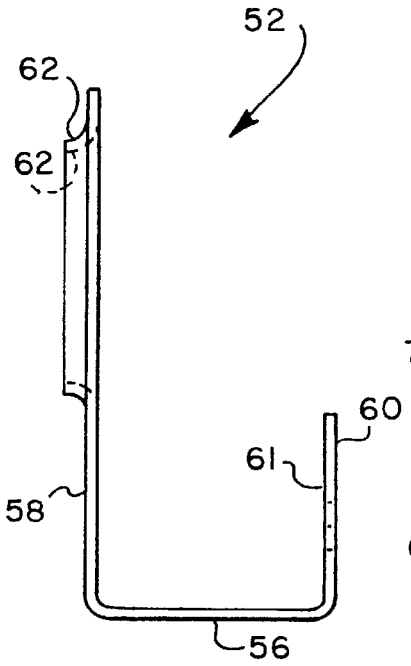
FIG. 2 is a side elevation of a wall support bracket for the counterbalance system showed in FIG. 1.
Figure 3:
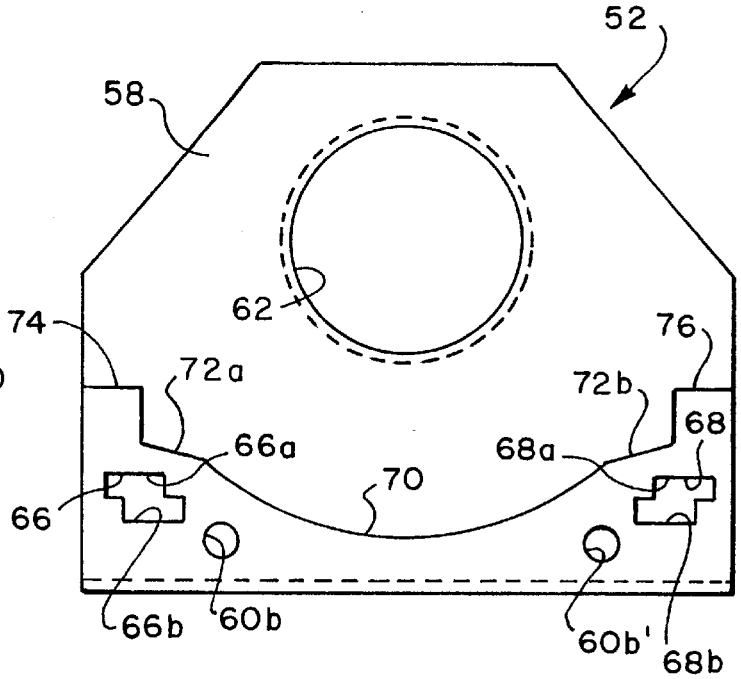
FIG. 3 is a front elevation of the bracket shown in FIG. 2.
Figure 4:
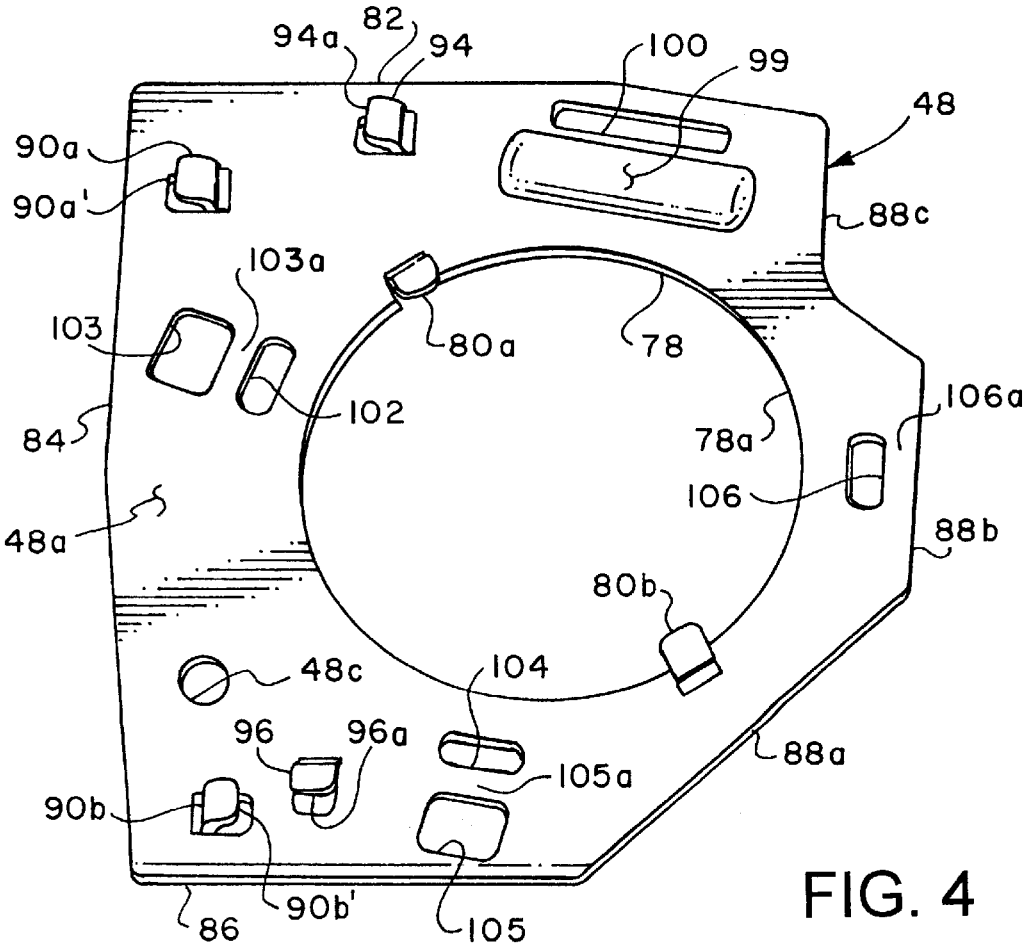
FIG. 4 is a perspective view of a winder mechanism support plate for the counterbalance system shown in FIG. 1 and in accordance with the present invention.

Referring further to FIG. 1, and also FIGS. 2, 3 and 4, the tubes 42 are suitably connected to respective winder mechanisms 46*a* and 46*b* to be described in further detail herein. The winder mechanisms 46*a* and 46*b* are connected to winder support plates 48 and 50 which, respectively, are supported on spaced apart opposed wall brackets, each generally designated by the numeral 52. The wall brackets 52 are adapted to be mounted on wall 12, as shown in FIG. 1, for supporting the counterbalance system 16. As also shown in FIG. 1, each of the wall brackets 52 is adapted to support a rolling element bearing assembly 54 which support the tube 18 for rotation with respect to the wall brackets 52.

Referring now primarily to FIGS. 2 and 3, each wall bracket 52 includes a generally planar base portion 56 integrally joined to spaced apart and generally parallel flanges 58 and 60. Flange 58 is provided with a generally cylindrical bore 62 defined in part by an integral collar 64 for receiving a bearing assembly 54 in snug or forced fit relationship. As shown in FIG. 3, the flange 60 is provided with spaced apart somewhat Z-shaped slots 66 and 68 which have, respectively, aligned and somewhat parallel first legs 66*a* and 68*a* which are spaced from and generally parallel to second legs 66*b* and 68*b*. Leg s 66*a* and 66*b* overlap to provide a portion of slot 66 which has a greater width than either of the legs. Slot 68 is essentially identical to slot 66 but is formed as a mirror image thereof on the flange 60. The flange 60 i s also substantially relieved along a curved wall section 70 which intersects opposed angled wall sections 72*a* and 72*b*. Angled wall sections 72*a* and 72*b* are joined, respectively, to opposed upstanding generally rectangular projections 74 and 76 of the flange 60 which are parallel, substantially co-extensive and further define the configuration of the flange 60. Also, flange 60 includes fastener receiving openings 60*b* and 60*b*' formed therein adjacent to slots 66 and 68 respectively.

Referring now to FIG. 4, the winder support plate 48 is illustrated in detail. The winder support plate 50 is identical but is a configuration which is a mirror image of the plate 48. The plate 48 is formed of metal sheet or plate and is configured to have a generally cylindrical bore 78 formed therein delimited by a borewall 78*a* and also interrupted by diametrically opposed, spaced apart tabs 80*a* and 80*b*, respectively. The tabs 80*a* and 80*b* project radially inwardly of the borewall 78*a* defining the bore 78 a predetermined amount sufficient to form stops engageable with one end of a winder tube 42.

The winder mechanism support plate 48 is of polygonal configuration and has a top wall 82, a back wall 84, a bottom wall 86, and a multi-segment front wall 88*a*, 88*b* and 88*c*. Opposed and spaced apart elements comprising tabs 90*a* and 90*b* project from a planar surface 48*a* of plate 48 and are formed by a suitable coining or punching operation. The tabs 90*a* and 90*b* each include distal end portions 90*a*' and 90*b*' which face in opposite directions, as shown, and are spaced from the planar surface 48*a*. The tabs 90*a* and 90*b* are proportioned such as to fit within the elements on the bracket 52 comprising the slots 68 and 66, respectively, by inserting the tabs laterally with respect to the plane of flange 60 and then rotating the plate 48 slightly such that the tab 90*a* may slide into the slot leg 68*b* while the tab 90*b* will fit within the slot leg 66*a*. In this position of the support plate 48 with respect to the bracket 52, the tab distal ends 90*a*' and 90*b*' will engage the inner wall 61 of the flange 60 within the slot legs 66*b* and 68*b*, respectively to prevent displacement of the plate from the bracket 52. As shown in FIG. 4, the support plate 48 also includes an opening 48*c* therein for receiving a fastener assembly to project through the opening 48*c* as well as the opening 60*b* in flange 60 when the support plate 48 is assembled to the bracket 52.

The winder mechanism support plate 48 further includes a tab 94 projecting from the surface 48*a* and including a distal end 94*a* spaced from the surface 48*a* and extending generally parallel to the tab 90*a*. Still further, a tab 96 projects from surface 48*a* and includes a distal end 96*a* spaced from surface 48*a* and which projects toward the bottom wall 86 of the plate 48. The support plate 48 is also formed to include a raised portion 99 formed in the planar surface 48*a* to provide a clearance recess in the opposite surface of plate 48 for a gear worm of winder mechanism 46*a*. An elongated slot 100 extends parallel to the longitudinal axis of the raised portion 99, and three circumferentially spaced slots 102, 104 and 106 are substantially evenly spaced about the bore 78 and positioned radially spaced outwardly from the borewall 78*a*. Generally rectangular slots 103 and 105 are formed in the plate 48 adjacent the slots 102 and 104, respectively. The slot 106 is adjacent the wall segment 88*b* and is spaced therefrom approximately the same distance as the spacing between the pairs of slots 102, 103 and 104, 105. The plate material forming a bridge between the slots 102 and 103 is designated by the numeral 103*a*, the material between the slots 104 and 105 is designated by the numeral 105*a* and the material which forms part of the plate 48 between the front wall segment 88*b* and the slot 106 is designated by the numeral 106*a*.

Figure 5:
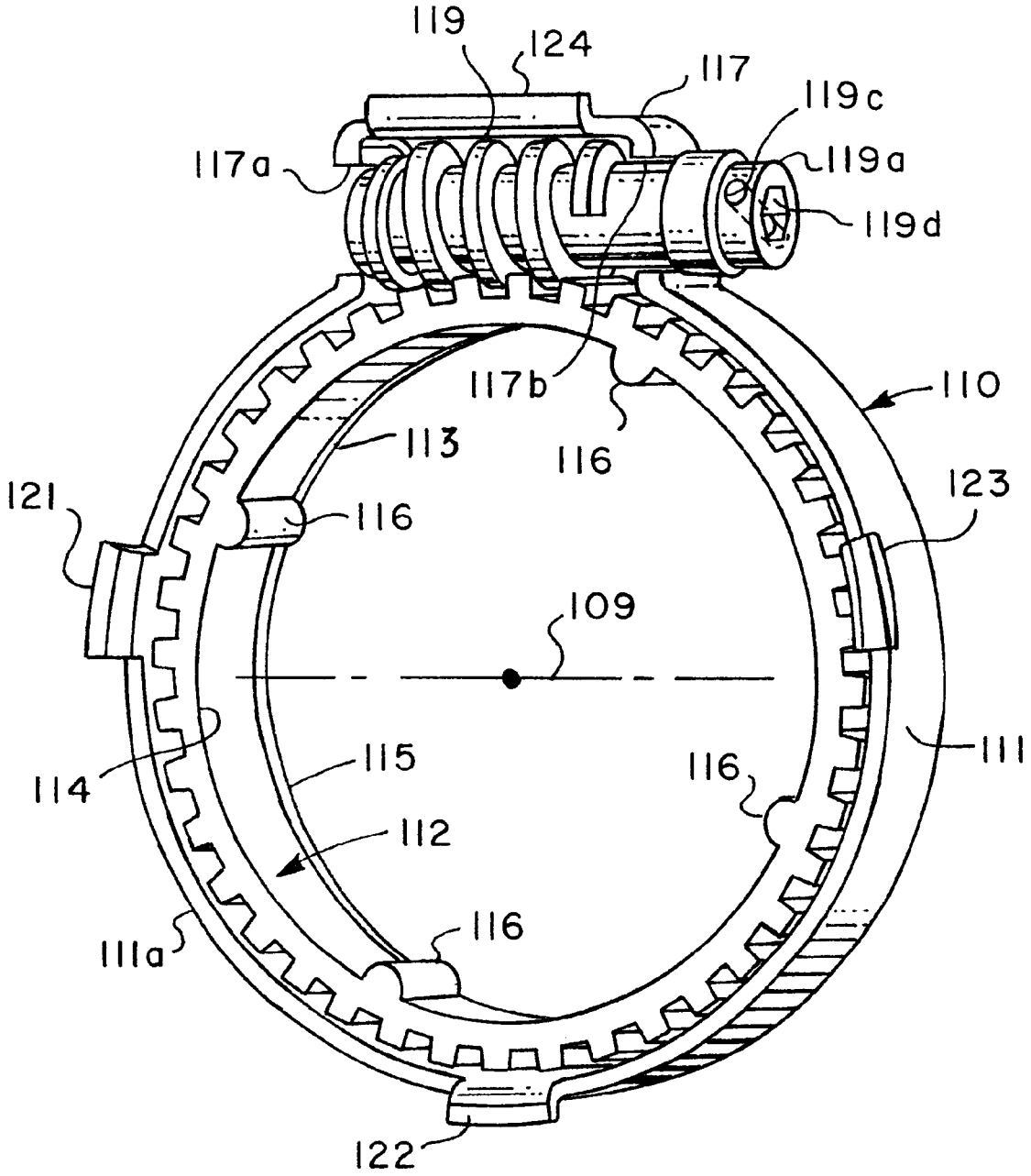
FIG. 5 is a perspective view of a portion of the winder mechanism showing the gearing and an enclosure or housing therefor.

Referring to FIG. 5, and also FIG. 1, the winder mechanism 46*a* is further illustrated by way of example. Each of the winder mechanisms 46*a* and 46*b* is further provided with a generally cup shaped gear housing 110 in which is disposed a cylindrical ring gear 112 having an inner bore 114 and four circumferentially spaced, inwardly projecting, axially extending key portions 116 formed thereon. The key portions 116 are adapted to be aligned with and insertable in corresponding grooves 41 formed by the axially extending key portions 40 of a tube 42. A tube 42 is operable to be disposed in snugly fitting sliding relationship within the bore 114 of the ring gear 112 and lockable for rotation with the ring gear.

The winder housing 110 is defined by a circumferential rim 111 integrally joined with a transverse end wall 113, FIG. 1, having a bore 115 formed therein for clearing the outside diameter of tube 42. A radially projecting hollow boss 117, FIG. 5, is formed with opposed axially extending slots 117*a* and 117*b* therein for receiving a worm gear 119 meshed with the ring gear 112.

The rim 111 of the winder housing 110 is provided with three circumferentially spaced axially and radially projecting tabs 121, 122 and 123. A fourth tab 124 is formed on the boss 117. The tabs 121, 122, 123, and 124 project radially outwardly away from a longitudinal central axis 109 of the housing 110 and the ring gear 112. The tab 124 is dimensioned to fit within the slot 100 of the winder mechanism support plate 48, and the tabs 121, 122 and 123 are adapted to fit within the slots 102, 104 and 106, respectively. The spacing of the slots 100, 102, 104 and 106, as well as the spacing of the tabs 121, 122, 123 and 124, is such as to allow insertion of the tab 124 in the slot 100 followed by movement by the housing 110 into registration of the rim surface 111*a* with the plate 48.

With the ring gear 112 journaled within the housing 110 and the worm 119 disposed within the hollow boss 117, as shown in FIG. 5, the winder mechanism 46*a* may be assembled by connecting the housing 110 to the plate 48 with the respective tabs 121, 122, 123 and 124 projecting through the slots 100, 102, 104 and 106, respectively. When the housing 110 is assembled to the plate 48, suitable means, not shown, are inserted in the slots 103 and 105 and engage the wall segment 88*b* and radially displace the material forming the bridge portions 103*a*, 105*a*, and 106*a*, FIG. 4, inwardly toward the bore 78 sufficiently such that this material slides under the distal ends of the tabs 121, 122 and 123. In this way, the housing 110 is suitably secured to plate 48 with the winder gearing formed by the gears 112 and 119 retained within the housing 110 and rotatable in response to rotation of the worm 119. In this regard, the worm 119 is provided with a drive tang 119*a* engageable by a power or manually operated tool, not shown, for rotating the worm and the winder ring gear 112. However, the drive tang 119*a* is provided with a transverse bore 119*c*, FIG. 5, extending therethrough and preferably intersecting a longitudinal bore 119*d* which may be provided for receiving a suitable hexhead drive tool, for example. The transverse bore 119*c* is provided for receiving a winder mechanism lock pin, not shown in FIG. 5, insertable in the bore 119*c* and operable to engage either the support plate 48 or the housing 110 to prevent any substantial rotation of the worm 119 and the ring gear 112 which would tend to relax the torsional windup of the counterbalance springs. Accordingly, a drive tool cannot be applied to the drive tang 119*a* without removing the aforementioned pin from bore 119*c*. In this way, a convenient inexpensive winder mechanism locking arrangement is provided by the present invention.

Figure 6:
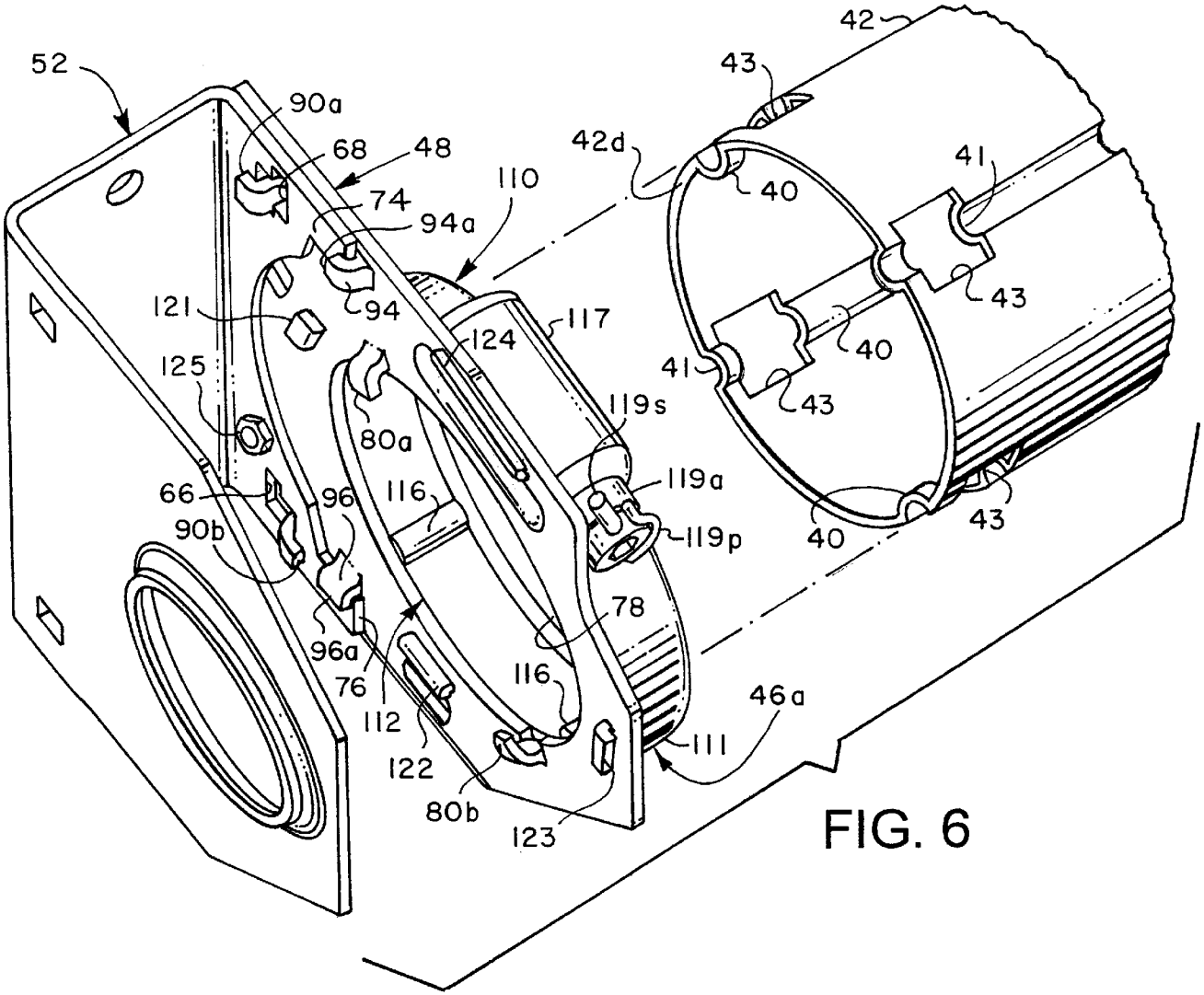
FIG. 6 is an exploded perspective view of one wall bracket, a winder mechanism and an associated winder tube in accordance with the present invention.

Referring now to FIG. 6, winder mechanism 46*a* is illustrated together with a wall bracket 52. A winder housing 110 is secured to winder support plate 48 with the aforementioned tabs 121, 122, 123 and 124 projecting through the corresponding slots 100, 102, 104 and 106 and with the bridge material 103*a*, 105*a*, and 106*a* displaced suitably radially inwardly under tabs 121, 122 and 123 to provide for securing the housing 110 to the plate 48.

FIG. 6 also illustrates the support plate 48 suitably secured on the bracket 52 with the tabs 90*a* and 90*b* projecting within the corresponding slots 66 and 68 in the manner described above. Additionally, it will be noted from viewing FIG. 6 that tab 94 is engageable with projection 76 on flange 60 and tab 96 is engaged with projection 74. In this way, forces transferred from the winder tube 42 to the plate 48 through the winder mechanism are distributed substantially evenly on the tabs 90*a*, 90*b*, 94 and 96 to minimize stress levels on any one of the tabs. Moreover, a suitable hexhead bolt and nut assembly 125 may be connected to the support plate 48 and the bracket 52 by inserting a hexhead bolt of the assembly through the openings 60*b* and 48*c* to provide for indicating that the bracket 52 and winder mechanism 46*a* are properly aligned with each other and to aid in maintaining the winder mechanism connected to the bracket 52.

As further shown in FIG. 6, a lock pin 119*p* is insertable in the transverse bore 119*c* of the drive tang 119*a* and includes a shank portion 119*s* which is engageable with the support plate 48 in response to any rotation of the worm 119 or, alternatively, the pin shank 119*s* will engage the ring gear housing 110 if the worm tends to rotate in the opposite direction more than about one hundred eighty degrees. In this way, the worm gear drive arrangement for the winder mechanism is prevented from unwanted rotation which may occur over a long period of time especially in situations where repeated vibrations are experienced by the counterbalance mechanism and which would tend to unwind the torsion springs, respectively. The pin 119*p* may be easily removed from the bore 119*c* when it is desired to apply a tool to the drive tang 119*a* to adjust the spring winder mechanism.

Referring further to FIG. 6, one end of a winder tube 42 is shown with the circumferentially spaced axial key portions 40 and including respective rectangular slots 43 intersecting each of the key portions, respectively. With the key portions 40 and their corresponding grooves 41 aligned with the key portions 116 on ring gear 112, the tube 42 may be slid into engagement with the ring gear extending through the bores 115 and 114 until the rectangular slots 43 are aligned with the key portions 116. The tube 42 may then be rotated slightly until the edges of the slots 43 engage the key portions 116 and the key portions 116 are moved out of alignment with the grooves 41. In this position of the tube 42 relative to ring gear 112, the tube is locked for rotation with the ring gear and is also prevented from being axially displaced out of the bore 114 in the ring gear. In this way, a unique easily releasable drive connection is formed between the winder mechanism and the tube 42 as long as there is negligible torque exerted thereon. The tabs 80*a* and 80*b* are operable to be engaged by the distal end 42*d* of tube 42 to prevent axial displacement of the tube too far inwardly into bore 78 during initial assembly of the tube to the part of the winder mechanism comprising the ring gear 112 and the housing 110.

Accordingly, torsion spring 32*a* transfers torque between cable drum 20 and wall bracket 52 by way of a spring cone or anchor member 34, tube 42, ring gear 112, worm 119, winder housing 110 and plate 48 to the wall bracket 52. Once the torsion spring 32*a* is prewound to counterbalance a substantial portion of at least half of the weight of door 10, reaction torque acting on plate 48 will tend to rotate the plate counterclockwise, viewing FIG. 6, to cause tabs 90*a* and 90*b* to forcibly engage the slots 66 and 68 while the tabs 94 and 96 also forcibly engage the projections 74 and 76, respectively, to distribute the forces acting between the bracket 52 and the plate 48 evenly over four separate tabs. Of course, key portions 116 of ring gear 112 forcibly engage the tube 42 at the slots 43 and the key portions 116, being rotationally displaced in the slots from the grooves 41 do not tend to disconnect from the tube 42.

The configuration of the support plate 48 and the wall bracket 52 is such that, whenever more than a very small amount of spring torque is exerted by spring 32*a* on the winder mechanism 46*a*, for example, the support plate 48 is retained in forcible locked engagement with the bracket 52.

The construction and operation of the winder mechanism 46*b* is substantially like that described above for winder mechanism 46*a*. The only difference in the construction of winder mechanism 46*b* is that the support plate 50 is configured as a substantially mirror image of support plate 48 and is otherwise identical thereto. A worm 119 for the winder mechanism 46*b* is preferably reversed in its position in the boss 117 so that the drive tang 119*a* projects in the same direction as the drive tang for the winder mechanism 46*a*. In all other respects, the winder mechanism 46*b* is identical to winder mechanism 46*a*.

Figure 7:
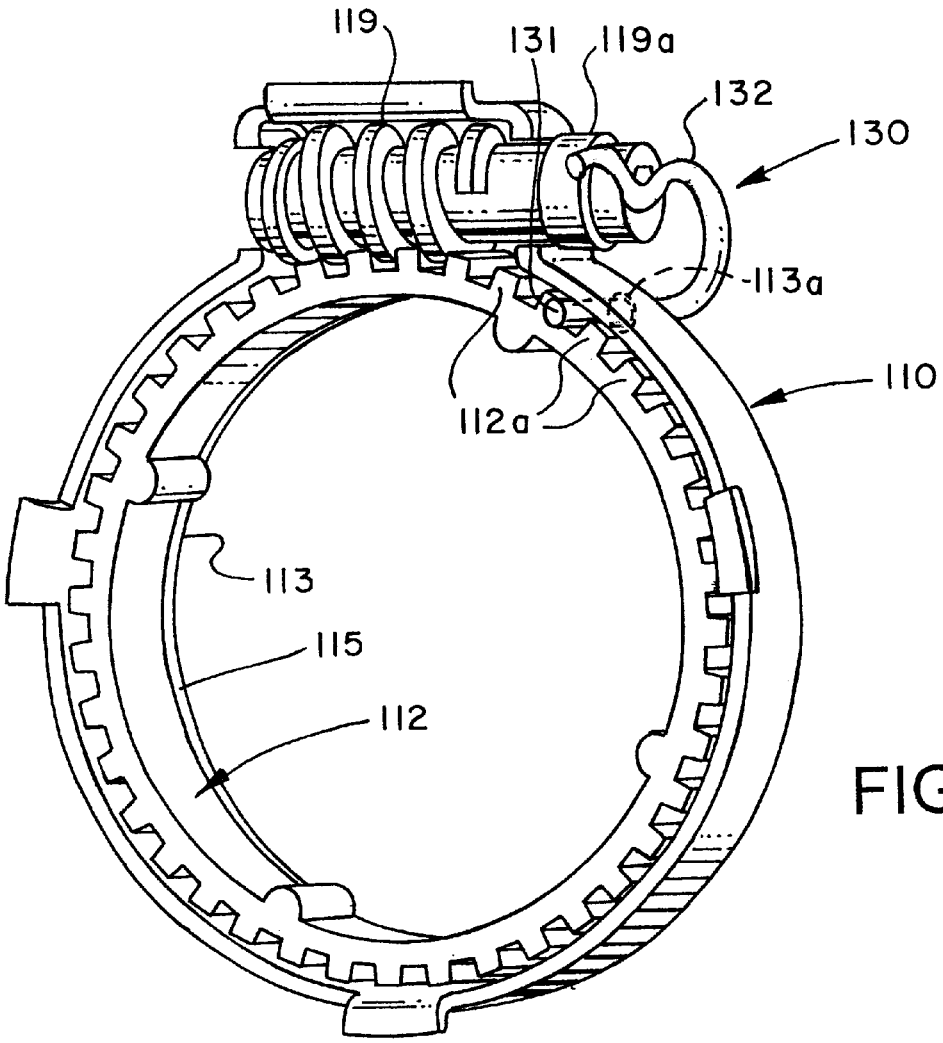
FIG. 7 is a view similar to FIG. 5 showing an alternate arrangement for locking the winder mechanism gearing against unwanted movement.

Referring now to FIG. 7, there is illustrated an alternate embodiment of winder mechanism 46*a*, shown by way of example, and showing an arrangement for locking the spring winder mechanisms 46*a* and 46*b* against unwanted rotation of the ring gear 112 and the worm 119. In the arrangement shown in FIG. 7, the ring gear housing 110 is modified to provide a bore 113*a* in the end wall 113 for receiving a locking pin 130 having a shank portion 131 operable to project through the bore 113*a* and between adjacent teeth 112*a* of the ring gear 112. The pin 130 includes a serpentine portion 132 which extends across the drive tang 119*a* to alert anyone attempting to apply a tool to the drive tang that the locking pin 130 is in a working position to prevent rotation of the ring gear 112. However, when it is desired to adjust the torsional windup of the torsion springs of the counterbalance mechanism, the pin 130 may be removed from the bore 113*a* and from between the gear teeth 112*a* to allow application of a tool to the drive tang 119*a* for rotation of the worm 119 and the ring gear 112.

Those skilled in the art will recognize and understand from the foregoing description the advantages of the winder mechanisms 46*a* and 46*b* and how these mechanisms provide for ease of fabrication, assembly and disassembly and operation substantially troublefree over an extended service life. Materials used for constructing the winder mechanisms 46*a* and 46*b* may be conventional materials used for components of counterbalance systems for upward acting residential and commercial garage doors and the like. Still further, the construction and operation of the counterbalance system 16, including the winder mechanisms 46*a* and 46*b*, is believed to be within the purview of one skilled in the art based on the foregoing description. Moreover, although preferred embodiments of the invention have been described in detail herein, those skilled in the art will also recognize that various substitutions and modifications may be made to the invention without departing from the scope and spirit of the appended claims.

What is claimed is:

1. A counterbalance system for an upward acting door, the counterbalance system comprising: at least one rotatable drum and a flexible element for winding thereon, said flexible element being adapted for connection to said upward acting door for exerting counterbalance forces thereon, a torsion spring operably engaged with said drum and with a winder mechanism for adjusting a torsional force of said spring, said winder mechanism including a support plate operably engaged with a wall bracket of said counterbalance system by cooperating elements on said support plate and said wall brackets, whereby rotational movement between said wall bracket and said support plate in one direction provides for disconnection of said support plate with respect to said wall bracket and rotational movement between said support plate and said wall bracket in the opposite direction causes said support plate to forcibly engage said wall bracket, said cooperating elements on said support plate and said wall bracket being arranged to prevent further rotational movement between said wall bracket and said support plate in said opposite direction, said cooperating elements for engaging said support plate with said wall bracket include a first pair of spaced apart tab members formed on said support plate and registered in spaced apart slots formed in said wall brackets, wherein one of said tab members engages an edge of one of said slots and the other of said tab members engages an opposing edge of the other of said slots.

2. The system set forth in claim 1 wherein:

said slots include offset leg portions, respectively, for receiving said tab members, said tab members being configured to be responsive to the rotational movement of said support plate in the one direction to provide for disconnection of said support plate with respect to said wall bracket, and said tab members being responsive to the rotational movement of said support plate in the opposite direction to forcibly engage said wall bracket under torsional forces exerted on said winder mechanism.

3. The system set forth in claim 1 wherein:

said support plate includes a second pair of spaced apart tab members formed thereon and engageable with said wall bracket to distribute torsional forces exerted between said wall bracket and said support plate among all of said tab members.

4. The system set forth in claim 1 wherein:

said support plate is adapted to support a winder mechanism thereon, said winder mechanism including a winder housing, a ring gear disposed for rotation in said housing, and a worm gear adapted to be meshed with said ring gear and supported on said housing, and a member interconnected between said ring gear and said torsion spring for transferring spring forces between said wall bracket and said drum through said torsion spring.

5. The system set forth in claim 4 wherein:

said member for transferring spring forces comprises a winder tube including at least one groove extending axially from one end of said tube toward another end of said tube, and at least one slot intersecting said at least one groove and extending laterally from said groove, said ring gear comprising at least one key portion for engagement with said at least one slot for locking said winder tube to said ring gear.

6. The system set forth in claim 5 wherein:

said at least one groove comprises a plurality of circumferentially spaced and axially extending grooves formed on said winder tube, and said at least one key portion of said ring gear includes corresponding circumferentially spaced inwardly projecting key portions formed on said ring gear and registrable in said grooves for inserting said tube in said ring gear in a predetermined orientation.

7. The system set forth in claim 6 wherein:

each of said grooves on said tube is intersected by said at least one slot for receiving a corresponding one of said key portions of said ring gear upon insertion of said tube within a bore of said ring gear.

8. The system set forth in claim 1 wherein:

said counterbalance system includes opposed wall brackets for supporting spaced apart respective rotatable drums thereon, and said counterbalance system includes opposed winder mechanisms operably connected to said wall brackets and to opposed ones of counterbalance springs for counterbalancing at least part of the weight of said door.

9. A counterbalance system for an upward acting door, the counterbalance system comprising: at least one rotatable drum and a flexible element for winding thereon, said flexible element being adapted for connection to said upward acting door for exerting counterbalance forces thereon, a torsion spring operably engaged with said drum and with a winder mechanism for adjusting a torsional force of said spring, said winder mechanism including a winder housing, a ring gear disposed for rotation in said housing, a worm gear adapted to be meshed with said ring gear and supported on said housing, and a winder tube interconnected between said ring gear and said torsion spring for transferring spring forces between a wall bracket and said drum through said spring, said winder tube including at least one elongated groove extending axially from one end of said tube toward another end thereof, and at least one slot intersecting said at least one groove and extending laterally from said groove, said ring gear comprising at least one key portion for engagement with said at least one slot for locking said winder tube to said ring gear.

10. The system set forth in claim 9 wherein:

said at least one groove comprises a plurality of circumferentially spaced and axially extending grooves formed on said winder tube, and said at least one key portion of said ring gear includes a corresponding plurality of circumferentially spaced inwardly projecting key portions registrable in said grooves for inserting said winder tube in said ring gear in a predetermined orientation.

11. The system set forth in claim 10 wherein:

each of said grooves on said winder tube is intersected by said at least one slot for receiving a corresponding one of said key portions of said ring gear upon insertion of said winder tube within a bore of said ring gear.

12. A counterbalance system for an upward acting door, the counterbalance system comprising: at least one rotatable drum and a flexible element for winding thereon, said flexible element being adapted for connection to said upward acting door for exerting counterbalance forces thereon, a torsion spring operably engaged with said drum and with a winder mechanism for adjusting a torsional force of said spring, said winder mechanism including a support plate supported on and engaged with a wall bracket of said counterbalance system by a first pair of spaced apart tab members formed on said support plate and registered with said wall bracket in spaced apart slots formed in said wall bracket, said tab members being releasable from said slots upon rotation of said support plate with respect to said wall bracket in one direction to provide for disconnection of said support plate with respect to said wall brackets and said tab members engaging opposing edges of said slots under the torsional force of said spring to prevent further rotation of said support plate with respect to said wall bracket in the opposite direction.

13. The system set forth in claim 12 wherein:

said winder mechanism includes a winder housing, a ring gear disposed for rotation in said housing, a worm gear adapted to be meshed with said ring gear and supported on said housing, and a member interconnected between said ring gear and said torsion spring for transferring spring forces between said wall bracket and said drum through said spring.

14. The system set forth in claim 13 wherein:

said member for transferring spring forces comprises a winder tube including at least one groove extending axially from one end of said tube toward another end of said tube, and at least one slot intersecting said at least one groove and extending laterally from said groove said ring gear including at least one key portion for engagement with said at least one slot for locking said tube to said ring gear.

15. The system set forth in claim 13 including:

a lock pin engageable with said worm gear to prevent unwanted rotation of said worm gear and said ring gear to change the torsional force exerted by said torsion spring.

16. The system set forth in claim 13 including:

a lock pin engageable with said ring gear to prevent unwanted rotation of said ring gear to change the torsional force exerted by said torsion spring.

17. The system set forth in claim 16 wherein:

said worm gear includes a drive tang that is engageable by a tool for adjusting a rotational position of said worm gear, said lock pin including a portion adapted to be positioned adjacent to said drive tang when said lock pin is engaged with said ring gear to interfere with the engagement of the tool with said drive tang.

18. A counterbalance system for an upward acting door, the counterbalance system comprising: at least one rotatable drum and a flexible element for winding thereon, said flexible element being adapted for connection to said upward acting door for exerting counterbalance forces thereon, a torsion spring operably engaged with said drum and with a winder mechanism for adjusting a torsional force of said spring, said winder mechanism including a closed winder housing, a ring gear disposed for rotation in said housing and a worm gear adapted to be meshed with said ring gear and supported on said housing, and a lock pin engageable with one of said ring gear and said worm gear and said housing.

19. The system set forth in claim 18 wherein:

said lock pin is engageable with said worm gear to prevent unwanted rotation of said worm gear and said ring gear to change the torsional force exerted by said torsion spring.

20. The system set forth in claim 19 wherein:

said worm gear includes a drive tang for adjusting a rotational position of said worm gear, said lock pin being adapted to extend through a bore formed in the drive tang.

21. The system set forth in claim 18 wherein:

said lock pin is engageable with said ring gear to prevent unwanted rotation of said ring gear to change the torsional force exerted by said torsion spring.

22. The system set forth in claim 21 wherein:

said worm gear includes a drive tang that is engageable by a tool for adjusting a rotational position of said worm gear, said lock pin includes a portion adapted to be positioned adjacent to the drive tang when said lock pin is engaged with said ring gear to interfere with the engagement of the tool with said drive tang.

* * * * *